US010876238B2

(12) United States Patent
Kongo

(10) Patent No.: US 10,876,238 B2
(45) **Date of Patent: *Dec. 29, 2020**

(54) SEWING MACHINE

(71) Applicant: Janome Sewing Machine Co., Ltd., Tokyo (JP)

(72) Inventor: Takeshi Kongo, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 347 days.

This patent is subject to a terminal disclaimer.

(21) Appl. No.: 15/967,618

(22) Filed: May 1, 2018

(65) Prior Publication Data

US 2018/0363185 A1 Dec. 20, 2018

(30) Foreign Application Priority Data

Jun. 16, 2017 (JP) ..... 2017-118341

(51) Int. Cl.

| | |
|---|---|
| ***D05C 9/22*** | (2006.01) |
| ***D05C 7/00*** | (2006.01) |
| ***D05B 3/04*** | (2006.01) |
| ***D05B 19/00*** | (2006.01) |
| ***D05B 19/08*** | (2006.01) |
| ***D05B 35/12*** | (2006.01) |
| ***D05B 69/12*** | (2006.01) |
| ***D05C 9/06*** | (2006.01) |
| ***D05B 19/16*** | (2006.01) |

(52) U.S. Cl.

CPC ..... *D05C 7/00* (2013.01); *D05B 3/04* (2013.01); *D05B 19/006* (2013.01); *D05B 19/08* (2013.01); *D05B 19/16* (2013.01); *D05B 35/12* (2013.01); *D05B 69/12* (2013.01); *D05C 9/06* (2013.01); *D05C 9/22* (2013.01); *D05D 2205/085* (2013.01)

(58) Field of Classification Search

CPC ..... D05B 19/105; D05B 19/10; D05B 19/16; D05C 9/22; H04N 5/272

See application file for complete search history.

(56) References Cited

U.S. PATENT DOCUMENTS

| | | | | |
|---|---|---|---|---|
| 6,161,491 A * | 12/2000 | Takenoya | D05B 19/02 112/102.5 |
| 9,650,734 B2 * | 5/2017 | Elliott | D05B 19/08 |
| 2013/0190916 A1 * | 7/2013 | Schnaufer | D05B 19/12 700/137 |

FOREIGN PATENT DOCUMENTS

| | | |
|---|---|---|
| JP | 2756694 B2 | 5/1998 |
| JP | 2000-271359 A | 10/2000 |
| JP | 2001120867 A | 5/2001 |

* cited by examiner

*Primary Examiner* — Tajash D Patel

(74) *Attorney, Agent, or Firm* — Nath, Goldberg & Meyer; Jerald L. Meyer

(57) ABSTRACT

A sewing machine that sews an embroidery pattern on a sewing object includes an embroidery frame horizontally moving along a direction which a frame surface extends, a needle bar supporting a needle for inserting a thread, and reciprocally moving toward an internal space of the embroidery frame, a memory unit storing image data of the embroidery frame, and embroidery data of the embroidery pattern, and a display unit displaying an image of the embroidery frame, an image of the embroidery pattern within the image of the embroidery frame, and a feature point with a positional relation between the embroidery pattern, and the embroidery frame when actually sewn in accordance with the embroidery data.

12 Claims, 13 Drawing Sheets

SEWING MACHINE

CROSS-REFERENCE TO RELATED APPLICATION

This application is based upon and claims the benefit of priority from Japan Patent Application No. 2017-118341, filed on Jun. 16, 2017, the entire contents of which are incorporated herein by reference.

FIELD OF THE INVENTION

The present disclosure relates to a sewing machine provided with an embroidery frame.

BACKGROUND

A sewing machine forms seams in accordance with embroidery data, and sews the embroidery pattern on a sewing object. This sewing machine stretches and holds the sewing object by an embroidery frame. The embroidery frame moves horizontally along the plane of a bed unit to change the stitch formation position. The embroidery data describes an operation procedure to form an embroidery pattern. For example, the embroidery data lists the moving amount of the embroidery frame to reach the next stitch.

There is a case in which a user wants to check the range of the embroidery pattern to be sewn in accordance with the embroidery data. That is, there is a request from the user to check that an embroidery pattern is present within the range of the embroidery frame, and that there is no collision between a needle and the embroidery frame.

Hence, a technology of tracing the range where the embroidery is sewn has been proposed. For example, Japan Patent No. 2756694 discloses to horizontally move the embroidery frame so that a needle point traces the contour line of a rectangle which contacts outwardly with the embroidery pattern. JP 2000-271359 A discloses to horizontally move the embroidery frame so that the needle point traces the contour line of a polygon, such as an octagon, or a circle that pass through the vertices of the embroidery frame. In addition, JP 2001-120867 A discloses to horizontally move the embroidery frame so that the needle moves along the entire circumference of the embroidery pattern.

According to the technologies of tracing the range related to the embroidery frame by the needle, when the user images the shape and position of the trace line, the user can grasp the positional relation among the embroidery frame, the sewing object, and the embroidery pattern.

According to the technologies of tracing the range related to the embroidery pattern by the needle, the user needs to keep imaging a residual image that indicates the shape and position of the trace line. When the user cannot properly image a residual image during the trace, or the residual image becomes unclear due to a concentration loss, the positional relation among the embroidery frame, the sewing object, and the embroidery pattern becomes ambiguous.

JP 2001-120867 A proposes to display the image of an embroidery pattern to be sewn on an operation panel, and to indicate the needle position in the trace by a marker. This proposal facilitates the user to image the contour of the trace line. In this point, the user is assisted to grasp the positional relation among the embroidery frame, the sewing object, and the embroidery pattern. However, since this is not a direct process for holding the residual image, this cannot prevent the residual image from fading out, and the positional relation among the embroidery frame, the sewing object, and the embroidery pattern will become ambiguous as the time goes by.

The present disclosure has been made to address the foregoing technical problems of conventional technologies, and an object is to provide a sewing machine capable of causing the user to grasp various positional relations, such as an embroidery pattern, an embroidery frame, and a sewing object without relying on the imagination ability of the user.

SUMMARY OF THE INVENTION

In order to achieve the above objective, a sewing machine according to the present disclosure sews an embroidery pattern on a sewing object, and includes:

an embroidery frame horizontally moving along a direction which a frame surface extends;

a needle bar supporting a needle for inserting a thread, and reciprocally moving toward an internal space of the embroidery frame;

a memory unit storing image data of the embroidery frame, and embroidery data; and a display unit displaying an image of the embroidery frame, an image of the embroidery pattern within the image of the embroidery frame, and a feature point, in accordance with a positional relation between the embroidery pattern, and the embroidery frame when actually sewn in accordance with the embroidery data.

The sewing machine may further include a selecting unit receiving a selection of the feature point by a user, and the embroidery frame may horizontally move until the needle points out a position in the embroidery frame corresponding to the feature point with the selection of the feature point by the user being a trigger.

The feature point may be a symbolic location which is easy to grasp a position and size of the embroidery pattern. Moreover, the feature point may be a leftmost end, a rightmost end, an uppermost end, or a lowermost end of the embroidery pattern.

The sewing machine may further include a feature point extracting unit extracting the feature point.

According to the present disclosure, since both the image of the embroidery frame and the image of the embroidery pattern are displayed with the positional relation of when the embroidery pattern is actually sewn, a user can grasp various positional relations without any imagination.

DETAILED DESCRIPTION OF THE EMBODIMENTS

Figure 1:
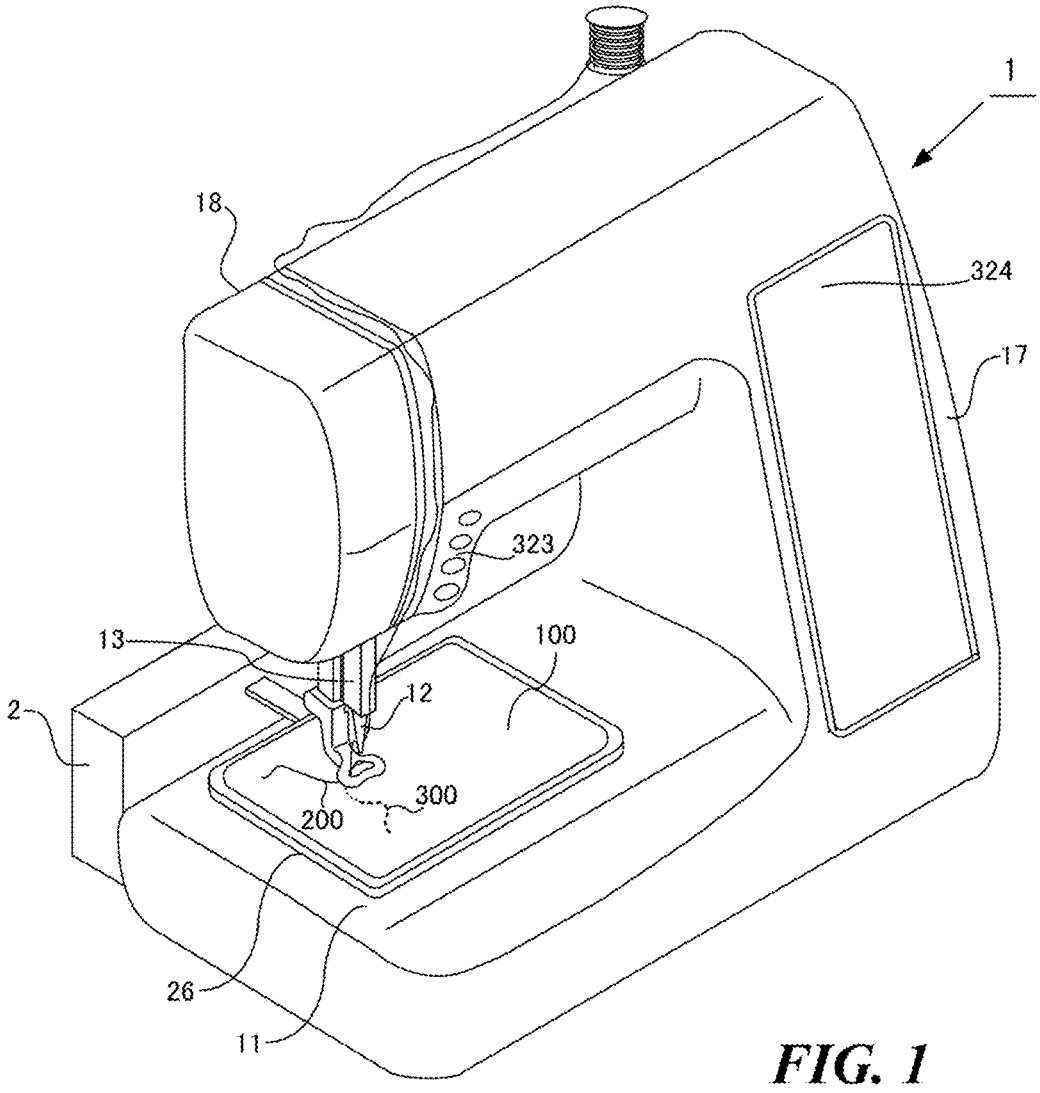
FIG. 1 is a diagram illustrating an entire structure of an appearance of a sewing machine.

A sewing machine according to each embodiment of the present disclosure will be described in detail with reference to the figures. As illustrated in FIG. 1, a sewing machine 1 is a home-use, professional, or industrial machine that form an embroidery on a sewing object 100. Example sewing objects are cloths and leathers. The sewing machine 1 stretches the sewing object 100 above the plane of a bed unit 11, directs a needle 12 toward the sewing object 100 from an arm unit 18 that faces the bed unit 11, inserts and removes the needle 12 relative to the sewing object 100, and forms a seam in the sewing object 100. The seam is formed by intertwining a needle thread 200 and a bobbin thread 300 with each other.

This sewing machine 1 includes a frame driving device 2. The frame driving device 2 horizontally moves an embroidery frame 26 along the direction which a frame surface extends above the bed unit 11. The embroidery frame 26 horizontally stretches and supports the sewing object 100 within the frame. The frame surface is a region surrounded by the frame. When the embroidery frame 26 horizontally moves, a position within the sewing object 100 where the needle 12 is inserted and removed, that is, the formation position of the seam changes, and the embroidery pattern that is a collection of seams is formed.

The sewing machine 1 is in a substantially reverse C-shape that has a neck unit 17 standing upright from the end of the bed unit 11, and has the arm unit 18 extended in parallel with the bed unit 11 from the neck unit 17. An operation screen 324 is installed in the neck unit 17, enabling a display of the status and an input of the operation, during the preparation of sewing and in sewing. Moreover, as for an input scheme of manual operation to horizontally move the embroidery frame, the sewing machine 1 includes jog keys 323 (see FIG. 4) that include up, down, right, and left buttons.

(Sewing Machine Body)

Figure 2:
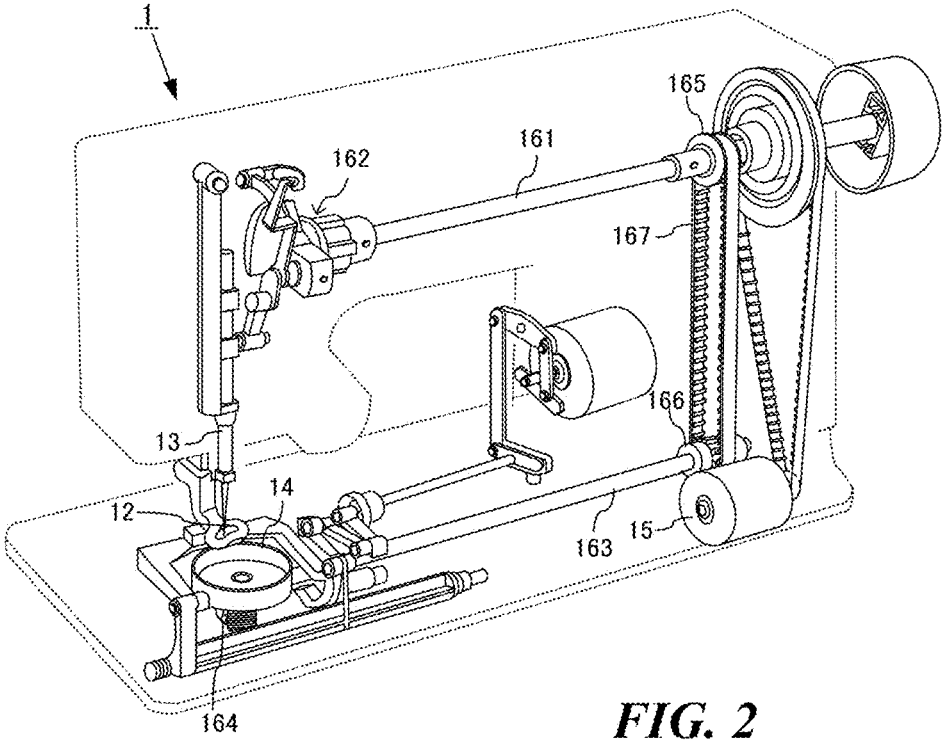
FIG. 2 is a diagram illustrating an internal structure of a sewing machine.

As illustrated in FIG. 2, the sewing machine 1 includes a needle bar 13 and a shuttle 14. The needle bar 13 extends vertically relative to the plane of the bed unit 11, and reciprocates in the axial direction. This needle bar 13 supports, at the tip located at the bed-unit-11 side, the needle 12 that holds the needle thread 200. The shuttle 14 is in a drum shape with a hollow interior and an opened plane, is attached horizontally or vertically, and is rotatable in the circumferential direction. In this embodiment, the shuttle 14 is attached horizontally. This shuttle 14 holds therein the bobbin which the bobbin thread 300 is wound around.

In this sewing machine 1, by the vertical movement of the needle bar 13, the needle 12 with the needle thread 200 penetrates the sewing object 100, and a needle-thread loop due to a friction between the sewing object 100 and the needle thread 200 is formed when the needle 12 moves up. Next, the needle-thread loop is trapped by the rotating shuttle 14, and the bobbin that has supplied the bobbin thread 300 passes through the needle-thread loop along with the rotation of the shuttle 14. Hence, the needle thread 200 and the bobbin thread 300 are intertwined with each other, and a seam is formed.

The needle bar 13 and the shuttle 14 are driven via respective transmission mechanisms with a common sewing-machine motor 15 being a drive source. An upper shaft 161 extending horizontally is connected to the needle bar 13 via a crank mechanism 162. The crank mechanism 162 converts the rotation of the upper shaft 161 into linear motion, and transmits to the needle bar 13 to move the needle bar 13 up and down. A lower shaft 163 extending horizontally is connected to the shuttle 14 via a gear mechanism 164. When the shuttle 14 is installed horizontally, the gear mechanism 164 is a cylindrical worm gear that has an axial angle of, for example, 90 degrees. The gear mechanism 164 converts the rotation of the lower shaft 163 by 90 degrees and transmits to the shuttle 14 to rotate the shuttle 14 horizontally.

A pulley 165 with a predetermined number of teeth is installed to the upper shaft 161. In addition, a pulley 166 that has the same number of teeth as that of the pulley 165 of the upper shaft 161 is installed to the lower shaft 163. Both the pulleys 165 and 166 are linked with each other via a toothed belt 167. When the upper shaft 161 rotates along with the rotation of the sewing-machine motor 15, the lower shaft 163 also rotates via the pulley 165 and the toothed belt 167. This enables the needle bar 13 and the shuttle 14 to operate synchronously.

(Frame Driving Device)

Figure 3:
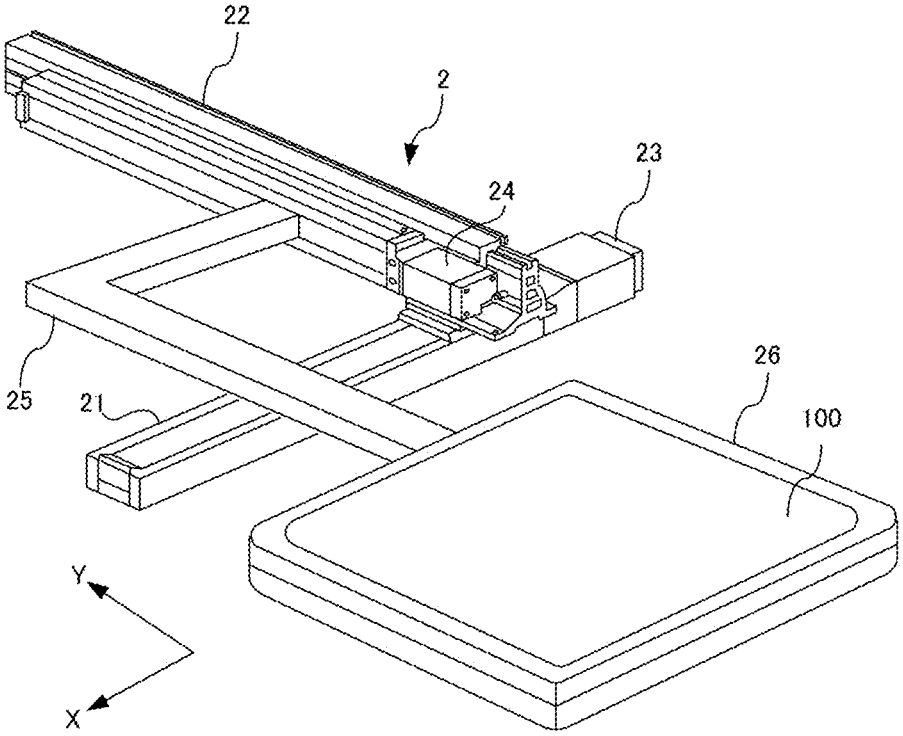
FIG. 3 is a diagram illustrating a detailed structure of a frame driving device.

As illustrated in FIG. 3, the frame driving device 2 is attachably installed to the sewing machine 1, or is installed inside the sewing machine 1. The frame driving device 2 holds the embroidery frame 26 by an embroidery frame arm 25, and includes an X linear slider 21 that moves the embroidery frame 26 in an X-axis direction, and a Y linear slider 22 that moves the embroidery frame 26 in a Y-axis direction. The X-axis direction is a lengthwise direction of the bed unit 11, and is generally the right and left direction of the user, and the Y-axis direction is a widthwise direction of the bed unit 11, and is generally the back-and-forth direction of the user.

The embroidery frame 26 includes an inner frame and an outer frame, holds the sewing object 100 between the inner frame and the outer frame by fitting the outer frame to the inner frame on which the sewing object 100 is placed, and fixes the sewing object 100. The sewing object 100 is located on the plane of the bed unit 11 so as to be movable horizontally along the fastened planar direction by the frame driving device 2.

(Control Device)

Figure 4:
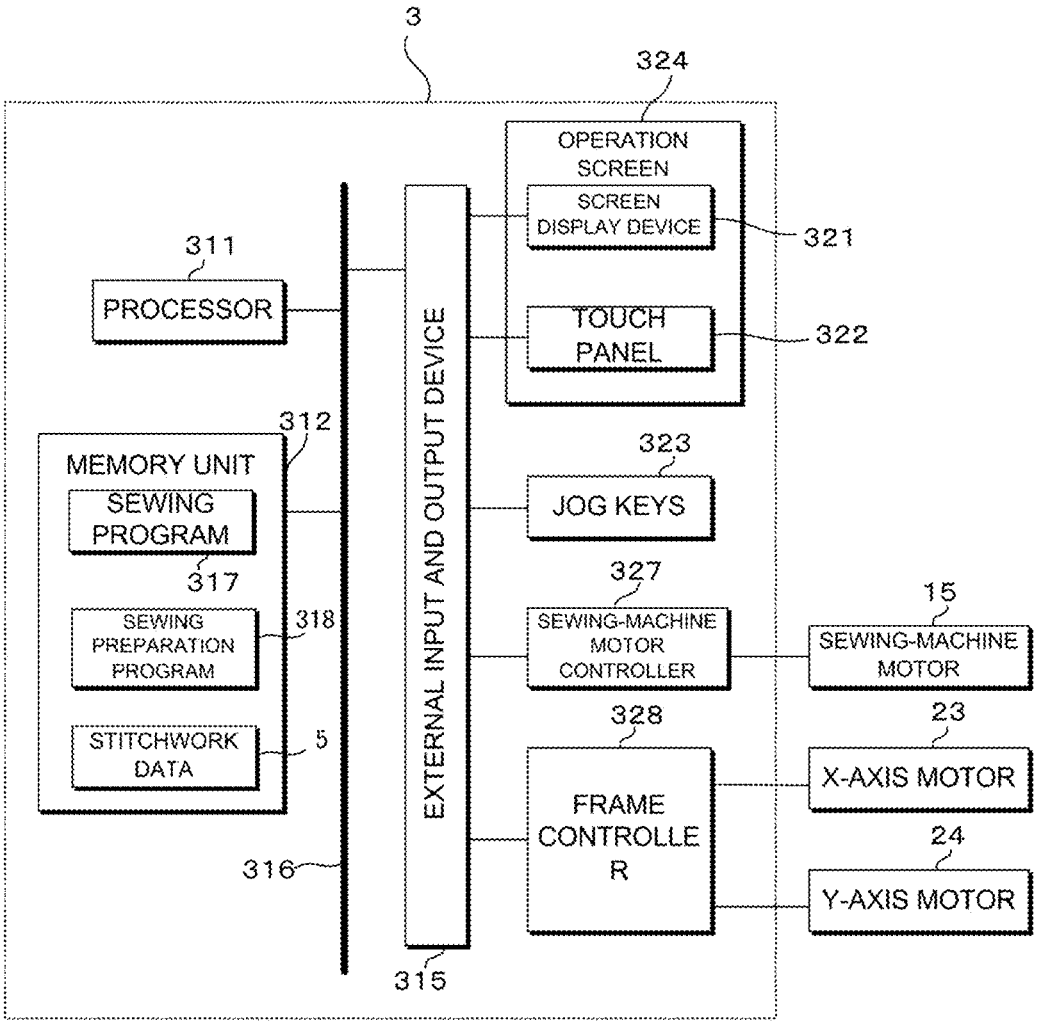
FIG. 4 is a block diagram illustrating a hardware structure of a control device of the sewing machine.

FIG. 4 is a block diagram illustrating a hardware structure of a control device 3 of the sewing machine 1. The control device 3 of the sewing machine 1 controls the horizontal movement of the embroidery frame 26. The control device 3 includes a so-called computer and peripheral controllers. The control device 3 includes a processor 311, a memory unit 312, and an external input and output device 315, connected together via a bus 316. Moreover, the control device 3 includes, a screen display device 321 via the external input and output device 315, a touch panel 322, the jog keys 323, a sewing-machine motor controller 327, and a frame controller 328.

The memory unit 312 is an internal storage and a work area. The internal storage is a non-volatile memory that stores programs and data. The work area is a volatile memory where the programs and the data are expanded. The non-volatile memory is, for example, a hard disk, an SSD, or a flash memory. The volatile memory is a RAM. This memory unit 312 stores a sewing program 317, a sewing preparation program 318, and embroidery data 5.

The processor 311 is also called a CPU or an MPU, and decodes and executes the codes described in the sewing program 317 and the sewing preparation program 318. As the execution result, the processor 311 outputs a control signal through the external input and output device 315 such as an I/O port. Moreover, a user operation signal is input to the processor 311 via the touch panel 322 and the jog keys 323.

The screen display device 321 includes a display controller, a depicting memory, and a liquid crystal display or an organic EL display, and displays display data transmitted by the processor 311 in a layout that is a format which can be understood by a user by visual checking, such as characters and figures. The touch panel 322 is a pressure-sensitive or electro-static type input device, and transmits a signal that indicates a touch position to the processor 311.

The screen display device 321 and the touch panel 322 are superimposed and integrated with each other, and serve as the operation screen 324 that has the screen display function and the touch operation function integrated. The jog keys 323 are a group of buttons for respective directions that are up, down, right, and left direction, and is a physical input device that transmits a signal in accordance with the user operation to the processor 311, or is icon keys within the touch panel 322 that are mainly utilized for manual operation of the embroidery frame 26.

The sewing-machine motor controller 327 is connected to the sewing-machine motor 15 via signal lines. In response to a control signal from the processor 311, the sewing-machine motor controller 327 causes the sewing-machine motor 15 to rotate at the speed indicated by the control signal, or to stop.

The frame driving controller 328 is connected to an X-axis motor 23 of the frame driving device 2 and a Y-axis motor 24 thereof via signal lines. The X-axis motor 23 is the drive source of the X linear slider 21, and the Y-axis motor 24 is the drive source of the Y linear slider 22. In response to the control signal from the processor 311, the frame driving controller 328 drives the X-axis motor 23 and the Y-axis motor 24 by a moving amount indicated by the control signal. For example, the frame controller 328 transmits pulse signals in accordance with the target position and speed contained in the control signal to the X-axis motor 23 and the Y-axis motor 24 that are each a stepping motor.

Figure 5:
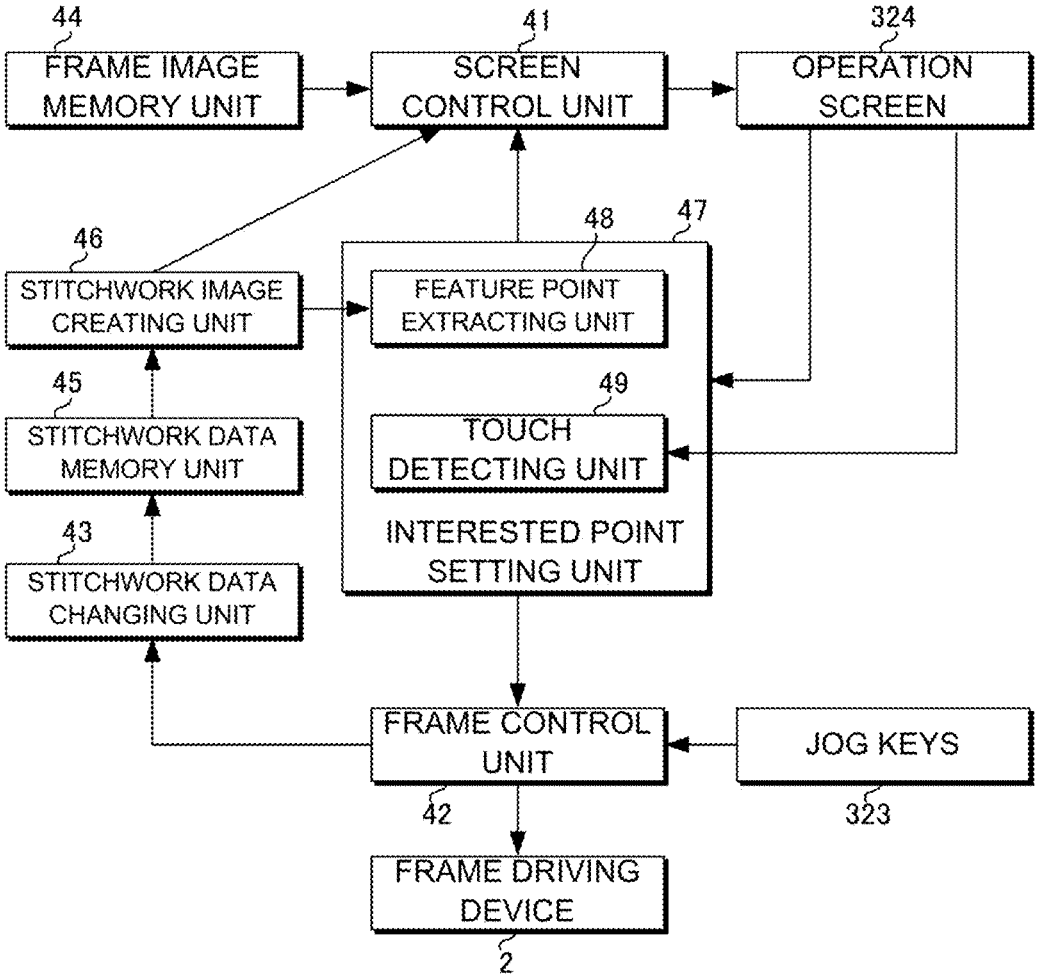
FIG. 5 is a block diagram illustrating a functional structure of the control device of the sewing machine.

FIG. 5 is a block diagram illustrating a structure of the control device 3 when executing the sewing preparation program 318. As illustrated in FIG. 5, the control device 3 includes a screen control unit 41, a frame control unit 42, and an embroidery data changing unit 43. Moreover, to provide various data to the screen control unit 41, the frame control unit 42, and the embroidery data changing unit 43, the control device 3 further includes an embroidery data memory unit 45, an embroidery image creating unit 46, a frame image memory unit 44, and an interested point setting unit 47. The interested point setting unit 47 includes a feature point extracting unit 48 and a touch detecting unit 49.

(Screen Control Unit)

The screen control unit 41 mainly includes the processor 311. This screen control unit 41 controls the operation screen 324. The screen control unit 41 reproduces, on the operation screen 324, the embroidery pattern to be formed in the embroidery frame 26 together with the positional relation between the embroidery frame 26 and the embroidery pattern.

Figure 6:
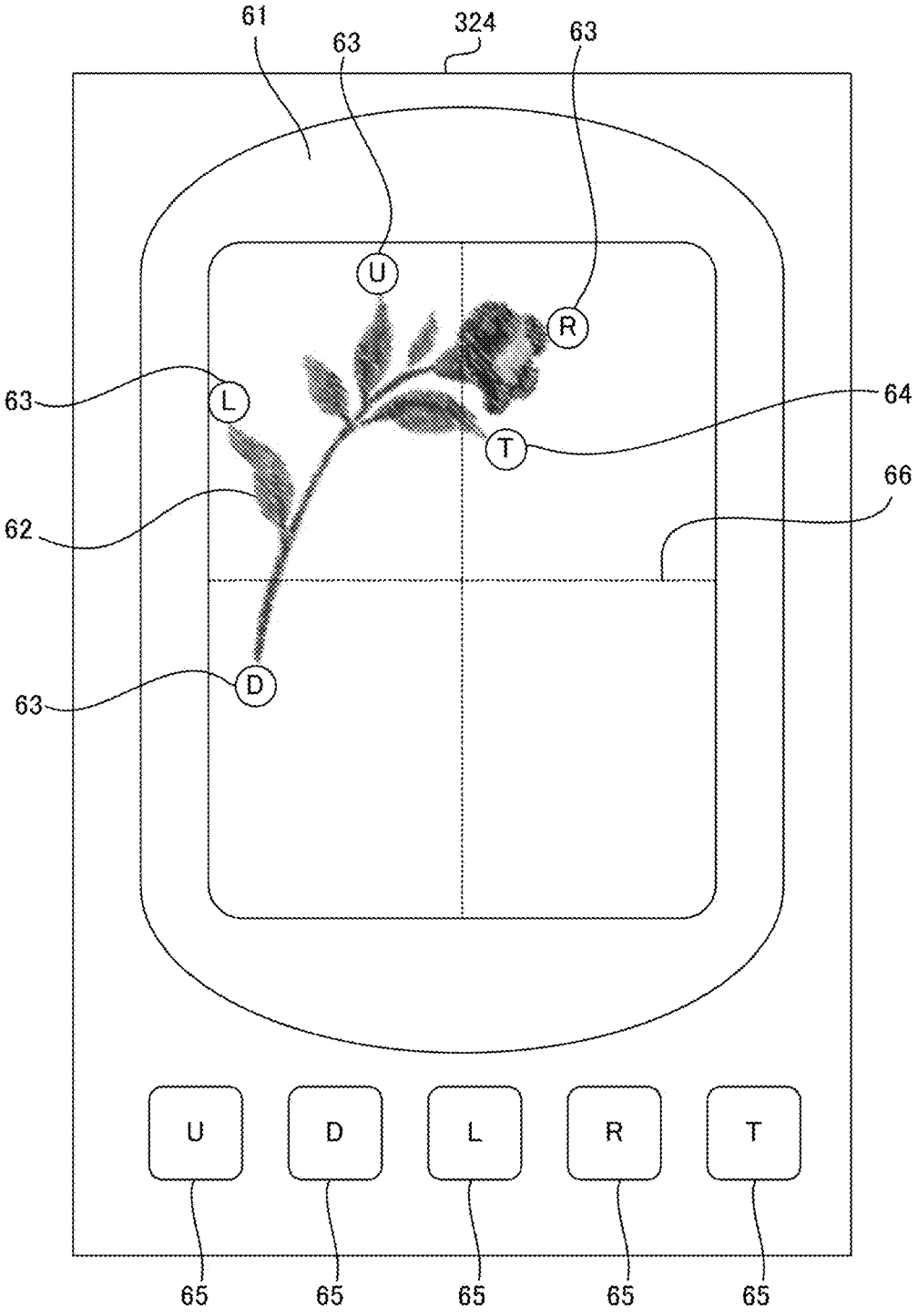
FIG. 6 is an exemplary diagram illustrating an operation screen of the sewing machine.

FIG. 6 is an exemplary diagram illustrating the operation screen 324. As illustrated in FIG. 6, the operation screen 324 displays a frame image 61 and an embroidery image 62. The frame image 61 is an image of the embroidery frame 26. The embroidery image 62 is an image of the embroidery pattern. The embroidery image 62 is depicted within the frame of the frame image 61 in accordance with the positional relation between the embroidery pattern and the embroidery frame 26 when actually sewn, with the positional relation to the embroidery frame 26 and the size being reproduced. A cross auxiliary line 66 for assisting the user to grasp the position of the embroidery image 62 is depicted in the frame image 61.

The frame image memory unit 44 includes the memory unit 312. This frame image memory unit 44 stores data of the frame image 61. The screen control unit 41 reads the data of the frame image 61 from the frame image memory unit 44, and writes the read data in the depicting memory of the screen display device 321. The operation screen 324 displays the frame image 61 in accordance with the pixel information in the depicting memory. The frame image 61 and the embroidery frame 26 have the shapes consistent. By recognizing the embroidery frame 26 at the sewing-machine-1 side, or accepting the user selection of the frame image 61, the image data corresponding to the embroidery frame 26 is read.

The embroidery image 62 is created from the embroidery data 5. The embroidery data memory unit 45 mainly includes the memory unit 312. The embroidery data 5 is stored in the embroidery data memory unit 45. The embroidery image creating unit 46 that mainly includes the processors 311 renders the embroidery image 62 in accordance with this embroidery data 5.

Figure 7:
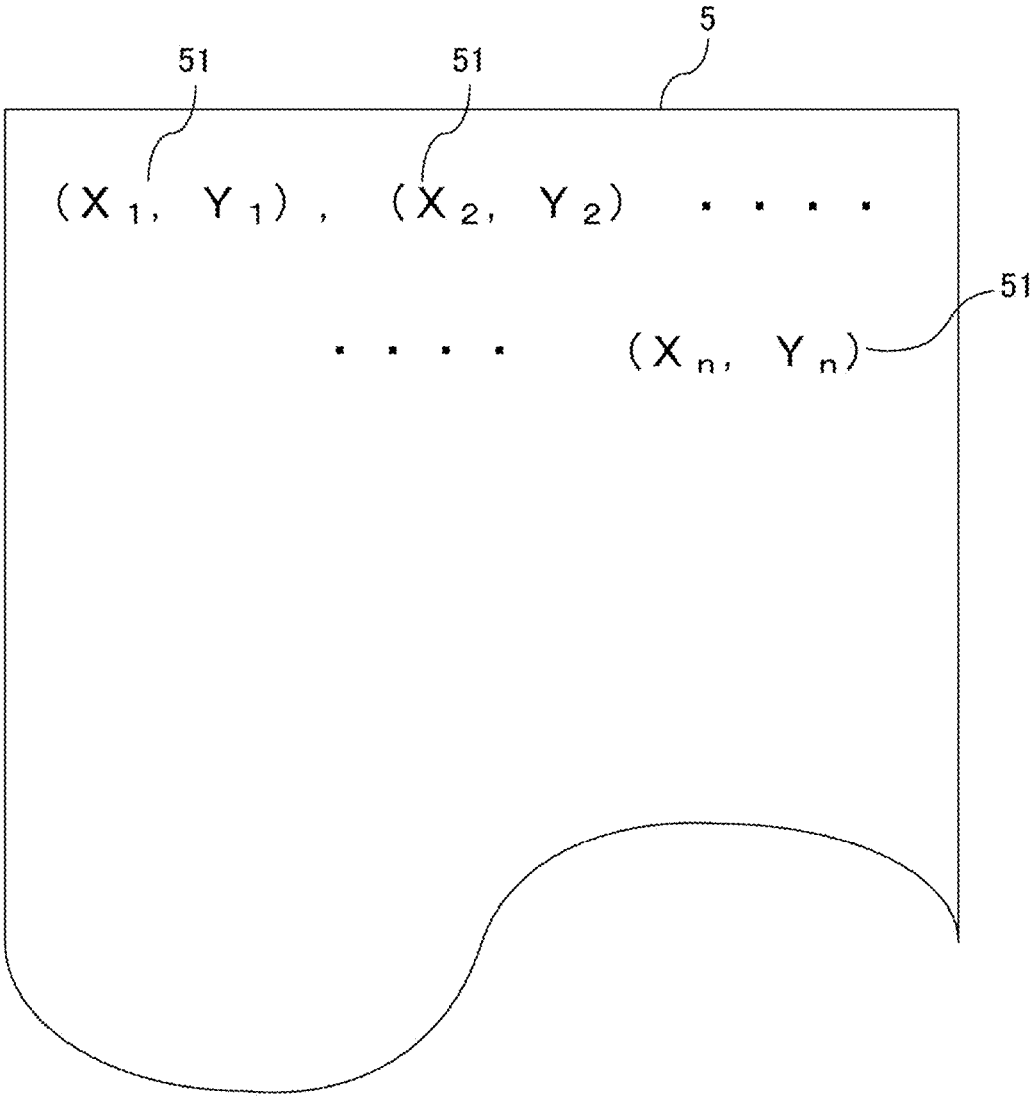
FIG. 7 is an exemplary diagram illustrating embroidery data.

In general, the rendering method is as follows. First, as illustrated in FIG. 7, seam position information 51 are arranged in the sewing order in the embroidery data 5. The position information 51 is indicated by the relative positional coordinate with reference to the last seam. That is, the position information 51 of the n-th seam (where n is a positive integer, such as n=1, 2, 3, is expressed by an X-axis direction moving amount and a Y-axis moving displacement amount from the (n−1)th seam. The position information 51 indicating the first seam is expressed by the moving amount from the origin. The origin is, for example, the center of the embroidery frame 26. Therefore, the embroidery data 5 also contains the information of the position of the embroidery pattern relative to the embroidery frame 26 in addition to the shape and size of the embroidery pattern.

Next, the embroidery image creating unit 46 develops the embroidery data 5 in the work memory, and converts this embroidery data 5 into an absolute positional coordinate. The absolute coordinate of a seam is acquired by adding all the position information 51 up to this seam. Here, the origin coordinate is (X0, Y0). Moreover, the position information 51 of the first seam is (X1, Y1). The embroidery image creating unit 46 converts the positional coordinate of the first seam into (X0+X1, Y0+Y1). In addition, the X coordinate of the n-th seam is converted into the sum of the X coordinate of the origin and the X-axis direction moving amounts of respective seams up to the n-th seam. The Y coordinate of the n-th seam is converted into the sum of the Y coordinate of the origin and the Y-axis direction moving amounts of respective seams up to the n-th seam.

Furthermore, the embroidery image creating unit 46 converts the absolute positional coordinate of a seam into the coordinate system on the operation screen 324 from the coordinate system of the embroidery frame 26. The screen control unit 41 changes the format of the embroidery image 62 expressed by the coordinate system of the operation screen 324 into a bitmap format, and writes the bitmap image in the depicting memory. The operation screen 324 displays the embroidery image 62 in the frame image 61 in accordance with the pixel information in the depicting memory.

As illustrated in FIG. 6, the operation screen 324 further displays feature point markers 63. The feature point markers 63 are each a drawing, such as a circle, that indicates the feature point of the embroidery pattern. The feature point is a symbolic point for identifying the position of the embroidery pattern. For example, the feature point is the uppermost end, lowermost end, rightmost end, or leftmost end of the embroidery pattern. These feature points are extracted by the feature point extracting unit 48 that mainly includes the processor 311.

The feature point extracting unit 48 extracts the feature point by analyzing the embroidery image 62. The seam with the smallest coordinate value in the Y-axis direction that is the axis of the vertical direction is a feature point at the uppermost end. Moreover, the seam with the largest coordinate value in the X-axis coordinate that is the axis of the horizontal direction is a feature point at the rightmost end. The feature point extracting unit 48 stores the positional coordinate of the feature point in the reserved memory area. The screen control unit 41 writes the feature point marker 63 at the position of the feature point in the depicting memory. The operation screen 324 displays the feature point marker 63 on the feature point of the embroidery image 62 in accordance with the pixel information in the depicting memory.

Moreover, as illustrated in FIG. 6, the operation screen 324 further displays a user designation point marker 64. The user designation point marker 64 is a drawing, such as a circle, that indicates a point designated by the user. The touch detecting unit 49 mainly includes the touch panel 322 and the processor 311, detects a touch operation, and informs the screen control unit 41 of the touch position. The screen control unit 41 displays the user designation point marker 64 on the informed touch position. The touch detecting unit 49 converts the user designated point to the coordinate system of the embroidery frame 26 from the coordinate system of the operation screen 324, and stores the conversion result in the reserved memory area.

The above feature point and user designation point that are indicated by the feature point marker 63 and the user designation point marker 64 are user's interested points. The feature point is a point specified prior to the user by the feature point extracting unit 48 as the candidate that can possibly become the user's interested point. The user designation point is restricted within the frame image 61. When the touch point is within the frame image 61, the touch detecting unit 49 informs the screen control unit 41 of the user designation point, and stores the position of the user designation point.

Figure 8:
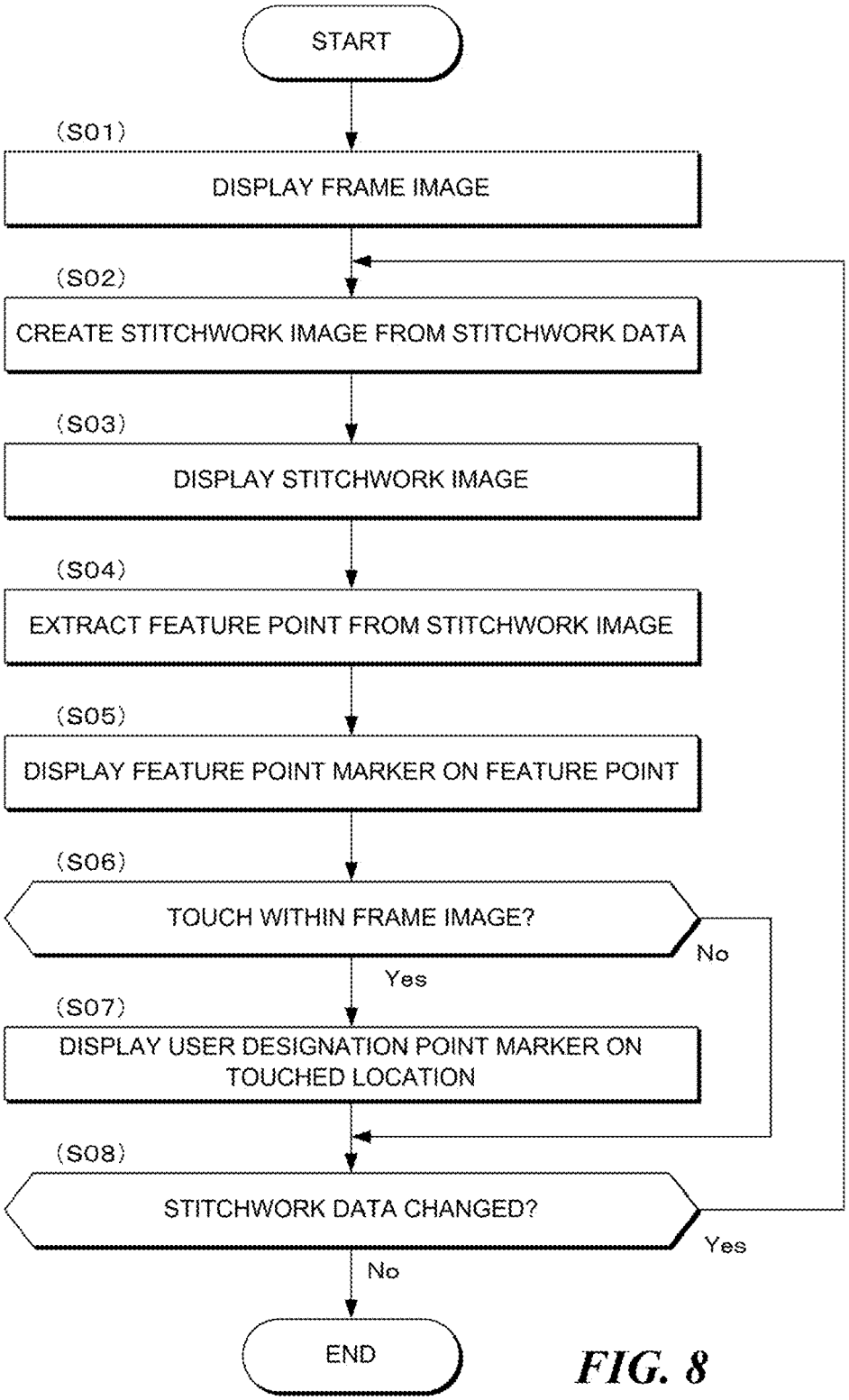
FIG. 8 is a flowchart illustrating a control operation of the operation screen.

FIG. 8 is a flowchart illustrating the example control operation of the operation screen 324 by the screen control unit 41. First, the screen control unit 41 reads the image data of the frame image 61, and displays the image data on the operation screen 324 (step S01). Next, the embroidery image creating unit 46 creates the image data of the embroidery image 62 from the embroidery data 5 (step S02). The screen control unit 41 displays the created embroidery image 62 on the operation screen 324 (step S03).

The feature point extracting unit 48 extracts the feature point from the embroidery image 62 (step S04). The image control unit displays the feature point marker 63 on the extracted feature point (step S05). Moreover, when the touch detecting unit 49 detects a touch within the frame image 61 (step S06: YES), the screen control unit 41 displays the user designation point marker 64 on the touched location (step S07).

Furthermore, when the embroidery data 5 is changed as will be described later (step S08: YES), the process returns to the step S02, and the image data of the new embroidery image 62 is created (step S02) and the embroidery image 62 is displayed again (step S03).

(Frame Control Unit)

The frame control unit 42 mainly includes the processor 311 and the frame controller 328. The frame control unit 42 controls the movement of the embroidery frame 26. First, the frame control unit 42 horizontally moves the embroidery frame 26 until the needle 12 points out the interested point. The interested point where the instruction by the needle 12 is performed is designated by the user using the operation screen 324.

As illustrated in FIG. 6, frame moving buttons 65 for each interested point indicated by each feature point marker 63 and user designation point marker 64 are disposed side by side below the frame image 61. This frame moving button 65 is a selecting unit that receives a user selection of the feature point marker 63 or the user designation point marker 64, and when the user depresses any of the frame moving buttons 65 by a touch operation, the frame control unit 42 moves the embroidery frame 26 until the needle 12 is located at the interested point indicated by the depressed frame moving button 65. That is, the frame control unit 42 accepts the coordinate value of the interested point designated by the user as the moving amount in the X-axis direction and Y-axis direction, and moves the embroidery frame 26 in accordance with the moving amount.

Secondly, the frame control unit 42 moves the embroidery frame 26 in response to the operation of the jog keys 323. The frame control unit 42 moves the embroidery frame 26 in accordance with the information indicating the operation direction and the operation amount input from the jog keys 323. When, for example, the up direction button is depressed n times, the embroidery frame 26 is moved by Y1×n mm in the Y-axis direction that is a direction the coordinate value decreases. When the right direction button is depressed m times, the embroidery frame 26 is moved by X1×m mm in the X-axis direction that is a direction the coordinate value increases. Furthermore, when the up direction button is kept depressed, the embroidery frame 26 is moved by the distance proportional to the depressing time in the Y-axis direction that is a direction the coordinate value decreases.

Figure 9:
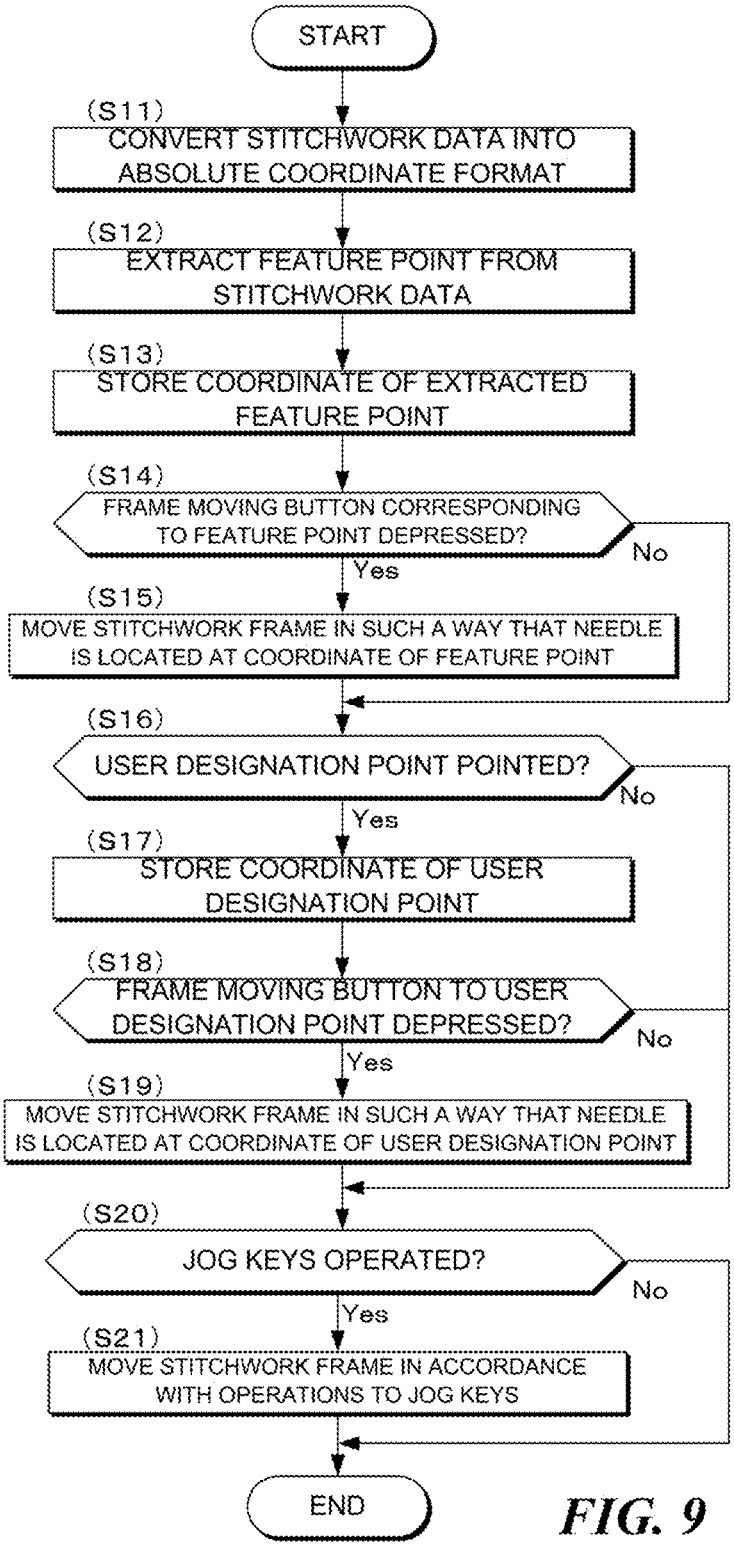
FIG. 9 is a flowchart illustrating a control operation of an embroidery frame.

FIG. 9 is a flowchart illustrating the frame control operation by the frame control unit 42. First, the embroidery image creating unit 46 converts the embroidery data 5 to the format of an absolute coordinate (step S11), and the feature point extracting unit 48 extracts the feature point from the embroidery data 5 in the absolute coordinate format (step S12). The interested point setting unit 47 temporarily stores the coordinate of this feature point (step S13).

When the frame moving button 65 to the feature point displayed on the operation screen 324 is depressed using the touch panel 322 (step S14: YES), the frame control unit 42 moves the embroidery frame 26 so that the needle 12 is located at the coordinate of the feature point indicated by the depressed button (step S15).

When the user designation point is designated using the touch panel 322 (step S16: YES), the interested point setting unit 47 temporarily stores the coordinate of the user designation point (step S17). Next, when the frame moving button 65 to the user designation point displayed on the operation screen 324 is depressed using the touch panel 322 (step S18: YES), the embroidery frame 26 is moved in so that the needle 12 is located at the coordinate of the user designation point (step S19).

Furthermore, when the user operates the jog keys 323 (step S20: YES), the embroidery frame 26 is moved by the same direction and amount as the operation direction and the operation amount of the jog keys 323 (step S21).

(Embroidery Data Changing Unit)

The embroidery data changing unit 43 includes the processor 311. This embroidery data changing unit 43 processes the embroidery data 5 in accordance with the operation of the jog keys 323. The movement of the embroidery frame 26 to designate the interested point by the needle 12 is set as a first condition, and further movement of the embroidery frame 26 by the operation of the jog keys 323 is set as a second condition. The embroidery data changing unit 43 processes the embroidery data 5 when this first condition and second condition are satisfied in sequence.

As for the details of data processing, the sewing position of the embroidery pattern indicated by the embroidery data 5 is shifted in accordance with the difference of the positions between two different points pointed out by the needle 12 before and after the manual operation of the jog keys 323. Before the operation of the jog keys 323, the needle 12 points out the interested point of the feature point or the user designation point. The difference between the interested point that is pointed out by the needle 12 and the point that is pointed out by the needle 12 after the operation of the jog keys 323 is calculated. That is, the embroidery data changing unit 43 calculates the distance in the X-axis direction the distance in the Y-axis direction the embroidery frame 26 is moved before and after the operation of the jog keys 323. The operation amount of the jog keys 323 may simply be calculated.

Next, the embroidery data changing unit 43 reflects this difference on the embroidery data 5. Typically, the embroidery data changing unit 43 adds the difference to the position information 51 indicating the first seam in the embroidery data 5 that relatively indicates the position information 51. The addition destination of the difference is the embroidery data 5 in the embroidery data memory unit 45. Hence, the position of the embroidery image 62 on the operation screen 324 is also updated. Accordingly, the embroidery data 5 is also shifted from the interested point by the direction and distance corresponding to the operation of the jog keys 323.

Figure 10:
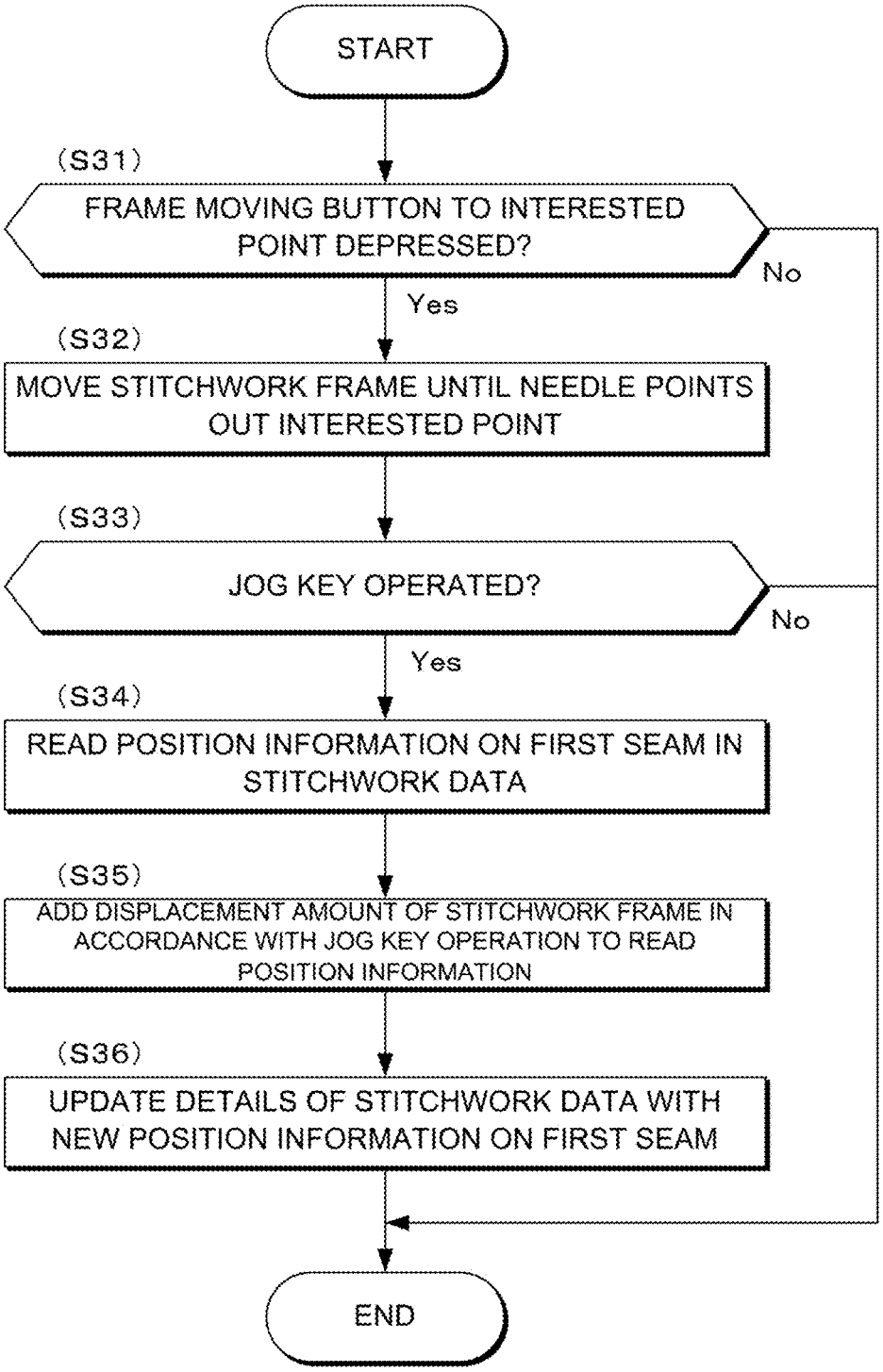
FIG. 10 is a flowchart illustrating a correction operation of the embroidery data.

FIG. 10 is a flowchart illustrating a correction operation of the embroidery data 5 by the embroidery data changing unit 43. First, when the frame moving button 65 to the interested point displayed on the operation screen 324 is depressed using the touch panel 322 (step S31: YES), the embroidery frame 26 is moved until the needle 12 points out the interested point determined by the user by button depression (step S32).

After the step S32, when the user operates the jog keys 323 (step S33), the embroidery data changing unit 43 reads the position information 51 of the first seam contained in the embroidery data 5 (step S34), and the X-axis direction moving amount and the Y-axis direction moving amount the embroidery frame 26 has been moved in accordance with the operation of the jog keys 323 are added to this position information 51 (step S35). The embroidery data changing unit 43 updates the details of the embroidery data 5 by this new position information 51 on the first seam (step S36).

(Action)

Figure 11A:
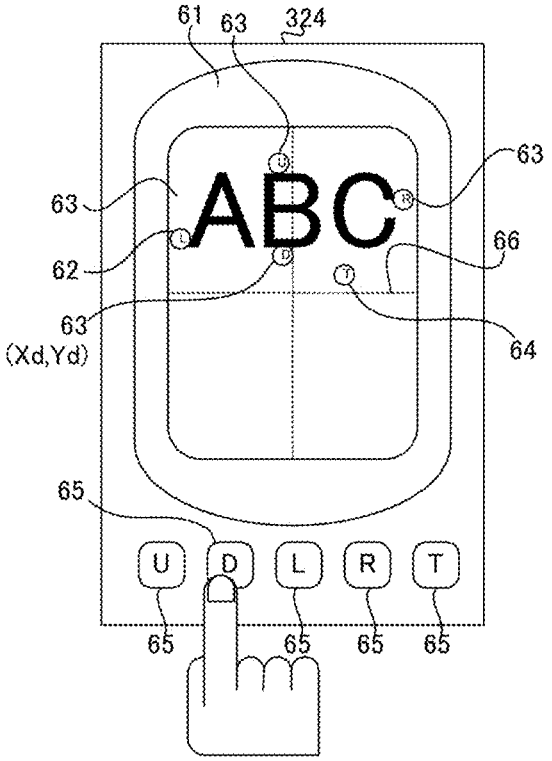
FIGS. 11A and 11B are each an explanatory drawing illustrating a relation between a feature point depression and an embroidery frame movement in the operation screen.

The action of the above sewing machine 1 will be described in detail. As illustrated in FIG. 11A, the operation screen 324 of the sewing machine 1 displays the embroidery image 62 in the frame image 61. The operation screen 324 displays the embroidery image 62 and the frame image 61 with the positional relation between the embroidery pattern and the embroidery frame 26 of when actually formed on the sewing object 100 in accordance with the embroidery data 5. Hence, the user can grasp the positional relation between the embroidery frame 26 and the actual embroidery pattern in accordance with the embroidery data 5 based on the embroidery image 62 and the frame image 61.

Figure 11B:
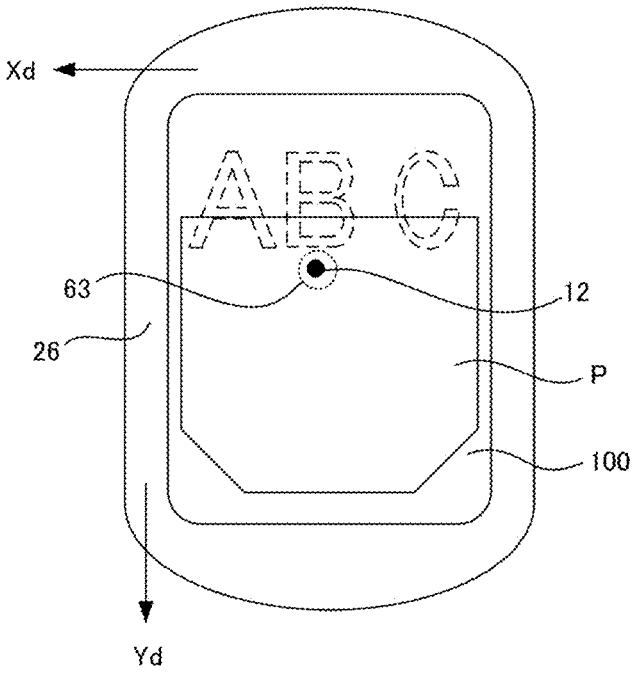

As illustrated in FIG. 11B, when the frame moving button 65 for the feature point is depressed, the embroidery frame 26 is horizontally moved until the needle 12 points out this feature point. The user can understand the position of the embroidery pattern on the sewing object 100 with reference to this feature point. That is, the positional relation among the embroidery frame 26, the embroidery pattern, and the sewing object 100 can be grasped even before the sewing by the operation screen 324 displaying the frame image 61 and the embroidery image 62, and by he embroidery frame 26 that horizontally moves until the needle 12 points out the feature point.

As illustrated in FIG. 11B, it is assumed that the embroidery data 5 of character alphabets A, B, and C is stored in the embroidery data memory unit 45. Moreover, the frame moving button 65 is depressed to the lowermost end is depressed. Hence, the embroidery frame 26 is moved until the needle 12 points out the lowermost end of the character alphabets A, B, and C. At this time, since the setting of the embroidery frame 26 relative to the sewing object 100 is not appropriate, the lowermost end of the character alphabets A, B, and C overlaps a pocket P of the sewing object 100. The user may correct the embroidery data 5, or set the sewing object 100 on the embroidery frame 26 again.

Figure 12A:
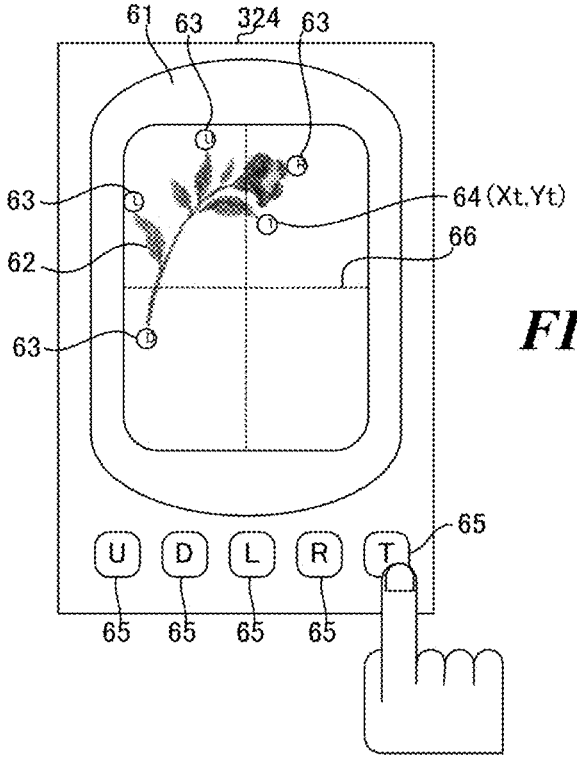
FIGS. 12A and 12B are each an explanatory drawing illustrating a relation between an interested point designation and an embroidery frame movement in the operation screen.

Next, for example, it is assumed that the embroidery data 5 of a flower attached to a stalk from which multiple leaves are extended is stored in the embroidery data memory unit 45. As illustrated in FIG. 12A, the operation screen 324 displays the embroidery image 62 of this flower. In this case, it is assumed that the user wants to dispose the embroidery pattern of the flower so that a butterfly B already sewn will be located under this flower.

Figure 12B:
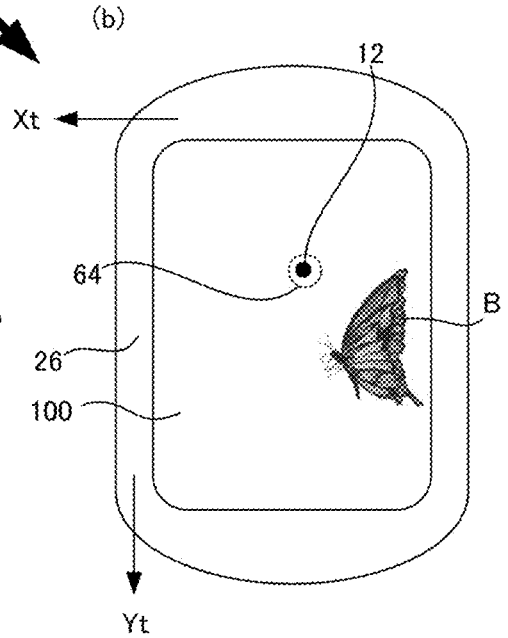

After the tip of leaf present under this flower is touched by the user and the user designation point marker 64 is displayed, the frame moving button 65 which sets the user designation point indicated by the user designation point marker 64 as the interested point is depressed. Accordingly, as illustrated in FIG. 12B, when sewing is performed in accordance with the embroidery data 5, the embroidery frame 26 is horizontally moved so that the needle 12 points out the tip of leaf present under the flower. This enables the user to grasp the positional relation between the user designation point that is the tip of leaf and the butterfly B.

Figure 12C:
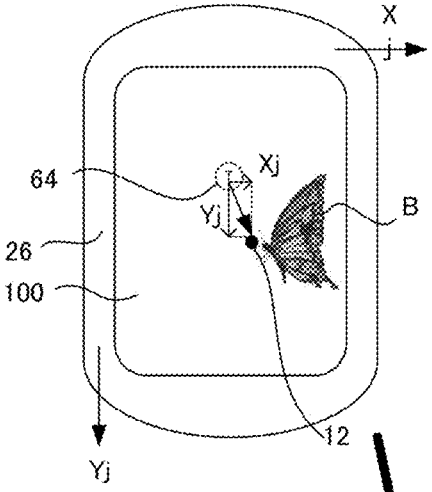
FIGS. 12C to 12E are each an explanatory drawing illustrating a jog key operation after the designation of the interested point.

The user can understand that the user designation point set under the flower is apart from the butterfly B already sewn, and it is further assumed that the user wants to move the flower so that the butterfly B is located at the tip of leaf. As illustrated in FIG. 12C, after the interested point is pointed by the needle 12 by the depression of the frame moving button 65, the jog key 323 are operated until the needle 12 is located at the point to which the interested point is desirably moved.

Figure 12D:
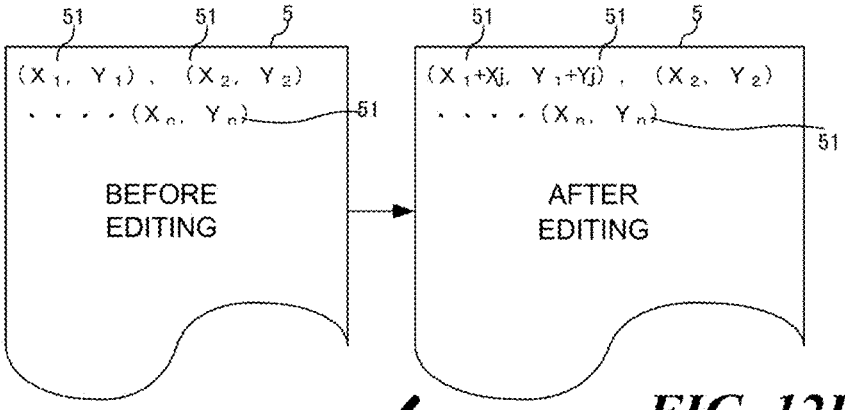
Figure 12E:
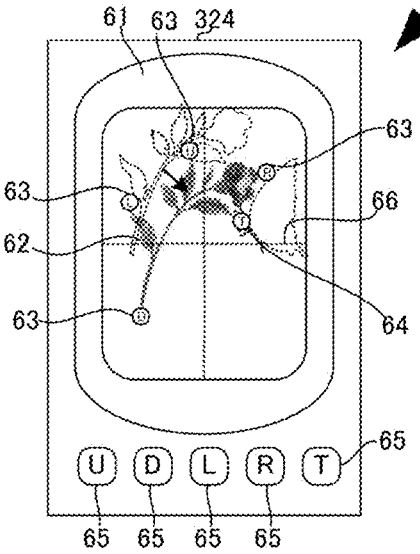

Accordingly, the embroidery data 5 of the flower is edited so that the butterfly is located under the flower. That is, the position pointed out by the needle 12 is changed from the location under the flower that is the interested point to the location near to the butterfly by the operation to the jog key 323. As illustrated in FIG. 12D, an X-axis direction component Xj and a Y-axis direction component Yj in this change amount are added to (X1, Y1) that is the original position information 51 of the first seam in the embroidery data 5. At this time, since the embroidery data 5 is changed, as illustrated in FIG. 12E, the operation screen 324 shifts and displays the embroidery image 62 of the flower.

Figure 13A:
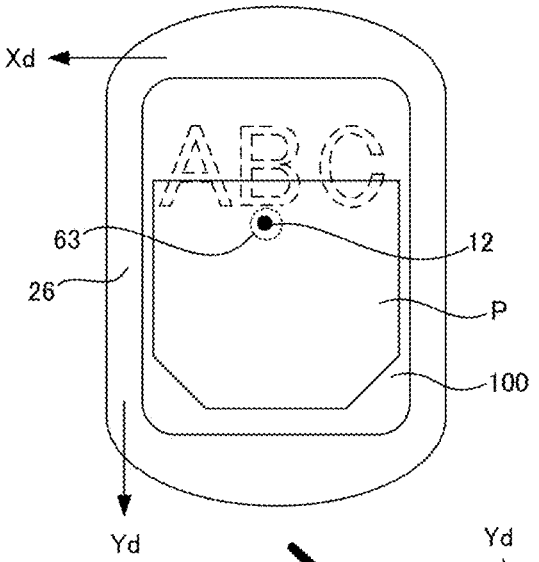
FIGS. 13A to 13C are each an explanatory drawing illustrating a jog key operation after the designation of the feature point.

Moreover, as illustrated in FIG. 13A, it is assumed that the frame moving button 65 having the lowermost end of the character alphabet A, B, and C as a index are depressed. Hence, the embroidery frame 26 keeps moving until the needle 12 points out the lowermost end of the character alphabets A, B, and C. At this time, it is assumed that, since the setting of the sewing object 100 to the embroidery frame 26 is not accurate, the lowermost end of the character alphabets A, B, and C overlaps the pocket of the sewing object 100.

Figure 13B:
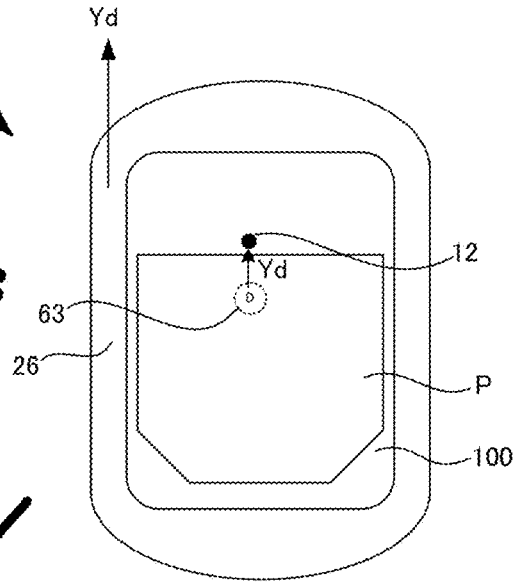
Figure 13C:
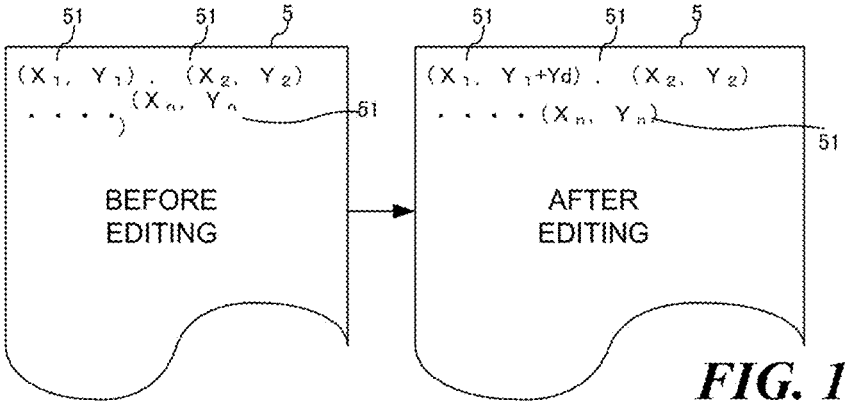

Hence, as illustrated in FIG. 13B, the user operates the jog keys 323, and moves the embroidery frame 26 until the needle 12 goes over the upper edge of the pocket. Accordingly, the embroidery data 5 is changed in so that the character alphabets A, B, and C is sewn apart from the pocket. That is, as illustrated in FIG. 13C, the moving amounts (0, Yd) in the X-axis direction and the Y-axis direction from the lowermost end of the character alphabets A, B, and C to the position pointed out by the needle 12 after the operation to the jog keys 323 are added to the position information 51 (X1, Y1) of the first seam in the embroidery data 5.

Hence, the designation of the interested point, and the designation of the movement destination of the interested point can be easily input only by the operation to the operation screen 324 and the jog key 323. Since the embroidery data 5 is shifted in accordance with this input, the alignment of the embroidery pattern is facilitated.

(Effect)

As described above, this sewing machine 1 includes the memory unit 312 and the screen display device. The memory unit 312 stores the image data of the embroidery frame 26 and the embroidery data 5. The display unit displays the image of the embroidery pattern in the image of the embroidery frame 26 with the positional relation between the embroidery pattern and the embroidery frame 26 when actually sewn in accordance with the embroidery data 5. Since both the images of the embroidery frame 26 and the embroidery pattern are displayed with the positional relation when sewing is to be actually performed, the user can grasp the positional relation between the embroidery frame 26 and the embroidery pattern without any imagination.

Moreover, the screen display device displays the feature point on the image of the embroidery pattern. Furthermore, the embroidery frame 26 is horizontally moved until the needle 12 points out the point within the embroidery frame 26 corresponding to the feature point with a user selection of the feature point being a trigger. Hence, the user can grasp the positional relation between the sewing object 100 and the embroidery pattern which is not provided by the operation screen 324. This feature point may be the leftmost end, the rightmost end, the uppermost end, and the lowermost end of the embroidery pattern. That is, the feature point may be a symbolic location easy to grasp the position and size of the embroidery pattern.

In this case, the interested point of the user to grasp the position or size of the embroidery pattern may vary depending on the objective for grasping the position or size of the embroidery pattern. When the objective is to grasp the positional relation with the other embroidery pattern or a decoration such as a pocket, the user may have an individual interested point other than the feature point of the embroidery pattern.

Hence, the combination of the screen display device and the touch panel 322 is disposed on the sewing machine 1 as the operation screen 324 that receives a touch operation to the screen. The operation screen 324 receives the designation of the position by the user by a touch within the image of the embroidery frame 26. The embroidery frame 26 is horizontally moved until the needle 12 points out the user designation point which is received by the operation screen 324. This enables the user to easily grasp the position of the user designation point on the sewing object 100.

Moreover, this sewing machine 1 includes the jog keys 323 and the embroidery data changing unit 43. The jog keys 323 receive the manual operation of the embroidery frame 26. By the manual operation using this jog keys 323, two points at different positions pointed out by the needle 12 before and after the manual operation are produced. The embroidery data changing unit 43 changes the embroidery data 5 so as to shift the sewing position of the embroidery pattern indicated by the embroidery data 5 in accordance with the difference between the positions of these two points.

The interested point designated by the user becomes an index for grasping whether the position of the embroidery pattern matches the users desire or not. Since the difference between the interested point and the position desired by the user is automatically reflected on the embroidery data 5 in conjunction with the operation to the jog keys 324, the user can easily match the position of the embroidery pattern with the position desired by the user.

Other Embodiments

Although the embodiment of the present disclosure has been described above, various omissions, replacements, and modifications can be made thereto without departing from the scope of the present disclosure. Such embodiment and modified form thereof are within the scope of the present disclosure, and also within the scope of the invention as recited in appended claims and the equivalent range thereto.

What is claimed is:

1. A sewing machine sewing an embroidery pattern on a sewing object, the sewing machine comprising:

an embroidery frame horizontally moving along a direction which a frame surface extends;

a needle bar supporting a needle for inserting a thread, and reciprocally moving toward an internal space of the embroidery frame;

a memory unit storing image data of the embroidery frame, and embroidery data of the embroidery pattern; and a display unit displaying an image of the embroidery frame, an image of the embroidery pattern within the image of the embroidery frame, and a feature point, in accordance with a positional relation between the embroidery pattern, and the embroidery frame when actually sewn in accordance with the embroidery data.

2. The sewing machine according to claim 1, further comprising a selecting unit receiving a selection of the feature point by a user, wherein the embroidery frame is horizontally moved until the needle points out a position in the embroidery frame corresponding to the feature point with the selection of the feature point by the user being a trigger.

3. The sewing machine according to claim 1, wherein the feature point is a symbolic location which is easy to grasp a position and size of the embroidery pattern.

4. The sewing machine according to claim 1, wherein the feature point is a leftmost end, a rightmost end, an uppermost end, or a lowermost end of the embroidery pattern.

5. The sewing machine according to claim 1, further comprising a feature point extracting unit extracting the feature point.

6. The sewing machine according to claim 2, further comprising a feature point extracting unit extracting the feature point.

7. The sewing machine according to claim 3, further comprising a feature point extracting unit extracting the feature point.

8. The sewing machine according to claim 4, further comprising a feature point extracting unit extracting the feature point.

9. The sewing machine according to claim 2, wherein the feature point is a symbolic location which is easy to grasp a position and size of the embroidery pattern.

10. The sewing machine according to claim 2, wherein the feature point is a leftmost end, a rightmost end, an uppermost end, or a lowermost end of the embroidery pattern.

11. The sewing machine according to claim 9, further comprising a feature point extracting unit extracting the feature point.

12. The sewing machine according to claim 10, further comprising a feature point extracting unit extracting the feature point.

* * * * *